343-909 SR
10/9/84 XR 4,476,471

United States Patent [19]

Sato et al.

[11] Patent Number: 4,476,471

[45] Date of Patent: Oct. 9, 1984

[54] ANTENNA APPARATUS INCLUDING FREQUENCY SEPARATOR HAVING WIDE BAND TRANSMISSION OR REFLECTION CHARACTERISTICS

[75] Inventors: Ikuro Sato; Susumu Tamagawa; Ryuichi Iwata, all of Tokyo, Japan

[73] Assignee: Nippon Electric Co., Ltd., Tokyo, Japan

[21] Appl. No.: 346,818

[22] Filed: Feb. 8, 1982

[30] Foreign Application Priority Data

Feb. 9, 1981 [JP] Japan ..... 56-17831
Feb. 10, 1981 [JP] Japan ..... 56-18711

[51] Int. Cl.[3] ..... H01Q 19/00

[52] U.S. Cl. ..... 343/779; 343/781 P; 343/909

[58] Field of Search ..... 343/779, 909, 781 P, 343/781 CA, 781 R, 910, 756, 840

[56] References Cited

U.S. PATENT DOCUMENTS

| | | | |
|---|---|---|---|
| 3,148,370 | 9/1964 | Bowman | 343/779 |
| 3,231,892 | 1/1966 | Matson et al. | 343/909 |
| 3,394,378 | 7/1968 | Williams et al. | 343/909 |
| 3,769,623 | 10/1973 | Fletcher et al. | 343/909 |
| 3,842,421 | 10/1974 | Rootsey et al. | 343/909 |
| 3,864,690 | 2/1975 | Pierrot | 343/909 |
| 3,924,239 | 12/1975 | Fletcher et al. | 343/909 |
| 3,961,333 | 6/1976 | Purinton | 343/909 |
| 4,017,865 | 4/1977 | Woodward | 343/909 |
| 4,160,254 | 7/1979 | Wise | 343/909 |
| 4,284,992 | 8/1981 | Gans | 343/909 |

OTHER PUBLICATIONS

Arnaud et al., "Resonant-Grid Quasioptical Diplexer", Electronics Letters, vol. 9, No. 25, 12-73.

Saleh et al., "A Quasi-Optical Polarization-Independent Diplexer for use in the Beam Feed System of Millimeter-Wave Antennas, IEEE Trans., vol. AP-24, No. 6, 11/1976.

*Primary Examiner*—Eli Lieberman
*Assistant Examiner*—Michael C. Wimer
*Attorney, Agent, or Firm*—Sughrue, Mion, Zinn, Macpeak & Seas

[57] ABSTRACT

An antenna having a frequency separator of the type comprising plural lattice structures of a periodic conductive pattern. Each lattice structure exhibits an inherent resonance frequency and an inductance-capacitance effect at frequencies below the inherent resonance frequency. The periodic conductive patterns are selected so that each of the lattice structures exhibits substantially the same inherent resonance frequency, and when placed at selected intervals, the plurality of lattice structures exhibit interactive resonance at frequencies below the inherent resonance frequencies. Each lattice also exhibits substantially equal inductance and capacitance with respect to obliquely incident electromagnetic waves in the TE and TM modes.

20 Claims, 42 Drawing Figures

ANTENNA APPARATUS INCLUDING FREQUENCY SEPARATOR HAVING WIDE BAND TRANSMISSION OR REFLECTION CHARACTERISTICS

BACKGROUND OF THE INVENTION

1. Technical Field

The present invention relates to an antenna apparatus including an improved frequency separator using frequency-selective reflecting surfaces (FSRSs).

2. Description of the Prior Art

In satellite communication, an increase in communication capacity necessitates the common use of a single reflector by two or more frequencies. In order that a common reflector can be used by a plurality of frequencies, beams of different frequencies transmitted from a plurality of electromagnetic horns to the reflector have to be composed, or beams of different frequencies reflected from the reflector to the plurality of electromagnetic horns have to be separated. It is known that this objective can be achieved by arranging, in the path of electromagnetic beams propagating through free space, a frequency-selective reflecting surface (FSRS) or surfaces having transmissive reflective characteristics which depend on the frequency.

As one of such FSRSs, there is known a metallic plate having square apertures periodically arranged in a lattice form. This lattice apparently serves as an inductance in a relatively low frequency region, and its transmission is 1 in principle at its resonance frequency. In a higher frequency region, there arise higher modes, each having its own resonance frequency and a certain transmission smaller than 1.

There is known a technique by which a plurality of such lattices are used in a lower frequency region, i.e., the region where the lattices act as inductances, to separate frequencies by utilizing the interaction resonance resulting from interactions between the lattices. This prior art, however, has the disadvantage that its resonance characteristic curve is steeply inclined and, if a wide band pass characteristic is to be obtained, will require many lattices, which not only are uneconomical but also increase transmission losses.

To obviate this disadvantage, the present inventors previously proposed a frequency separator whose pass band is set in a frequency region higher than the region where an FSRS having a lattice of square apertures is considered an inductance but lower than the inherent resonance frequency of the lattice and in which a plurality of lattices are arranged at prescribed intervals. Reference is made to the published unexamined Japanese patent application No. 137703/81. Lattices in the pass band so set can be regarded as resonance elements of inductance capacitances (LCs), and the resonance of each lattice coupled with that resulting from interactions between the lattices enabled a frequency separator having a wide band pass characteristic to be realized.

This frequency separator proposed by the present inventors, however, involves the problem that, because it uses a lattice of square apertures, incoming electromagnetic waves of the transverse electric (TE) mode and those of the transverse magnetic (TM) mode will have different resonance frequencies if those waves obliquely come incident on an FSRS. This results in a deterioration in its frequency characteristic and leads to the frequency characteristic widely different from that for normally incident waves. In connection with this problem, there is known a technique using a lattice of rectangular, instead of square, apertures. It is disclosed in, for example, "A Quasi-Optical Polarization-Independent Diplexer for Use in the Beam Feed System of Millimeter-Wave Antennas" by A. A. M. Saleh et al published in the IEEE Transactions on Antennas and Propagation, Vol. AP-24, No. 6, November 1976, pp. 780–785. According to this article, the periodicity and size of apertures in the lattice are so determined that, the FSRS being regarded as an inductance, the inductance of the vertical strip of apertures and that of the horizontal strip be identical with respect to obliquely incident waves. However, this proposal, which regards the lattice as an inductance, cannot be helpful in improving the performance of a frequency separator like that proposed by the present inventors, in which the lattice is caused to serve as an LC resonance element with a view to giving the separator wide band pass characteristics.

SUMMARY OF THE INVENTION

One object of the present invention, therefore, is to provide an antenna apparatus including a frequency separator which is relieved of the performance deterioration resulting from the oblique incidence of electromagnetic waves on FSRSs where the FSRSs are regarded as the resonance elements of LCs.

According to the present invention, there is provided an antenna apparatus comprising frequency separator means having a plurality of frequency-selective reflecting surface members for separating electromagnetic waves, and two electromagnetic horn means for feeding the electromagnetic waves to the surface members at an arbitrary angle, each of the surface members having a lattice in turn having a periodic pattern of conductive material and inherent resonance frequency, the inherent resonance frequency being substantially equal to each other among the surface members, the lattice being capable of serving as an inductive-capacitive circuit element at specific frequency region lower than the inherent resonance frequency and exhibiting substantially equal inductance and capacitance with respect to the electromagnetic waves when made obliquely incident in the TE and TM modes, the surface members being disposed to have an interactive resonance at a frequency lying within the specific frequency region.

Other features and advantages of the present invention will become more apparent from the detailed description hereunder taken in conjunction with the accompanying drawings.

BRIEF DESCRIPTION OF THE DRAWINGS

Referring now to the drawings, in which like reference numerals denote like structural elements.

DETAILED DESCRIPTION OF INVENTION

Figure 1:
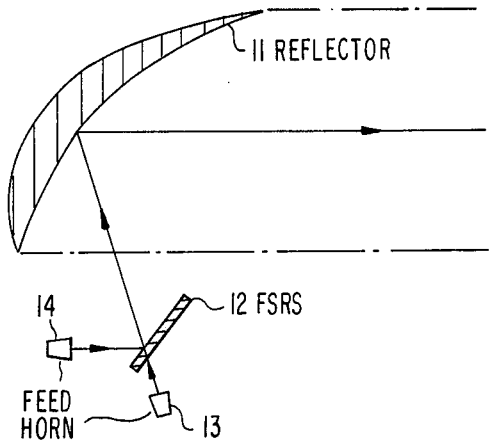
FIG. 1 illustrates an antenna system to which the present invention is applicable.

FIG. 1 shows an offset type antenna in which a frequency-selective reflecting surface (FSRS) 12 is used for transmitting and reflecting electromagnetic waves fed from two horns 13 and 14 in the same direction with a single reflector 11. The horn 13 transmits a signal whose frequency is within the pass band of the FSRS 12, through the FSRS 12 to the reflector 11 which in turn reflects it to the intended direction D. Meanwhile, the horn 14 transmits a signal whose frequency is in the reflection band of the FSRS 12, to the FSRS 12 from which the signal is reflected to the reflector 11 and also reflected thereat to be sent out in the direction D.

Conversely, it is also possible to separate signals coming in on the reflector 11 from the direction opposite to D and to receive them with the horns 13 and 14, and it may be readily understood that both or either of the horns 13 and 14 can be used for the receiving purpose.

Figure 2:
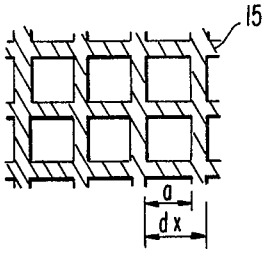
FIG. 2 shows a front view of the structure of a conventional FSRS using lattice with square apertures.
Figure 3:
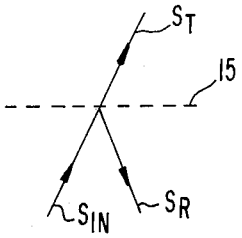
FIG. 3 illustrates the path of an electromagnetic wave incident upon the FSRS shown in FIG. 2.
Figure 4:
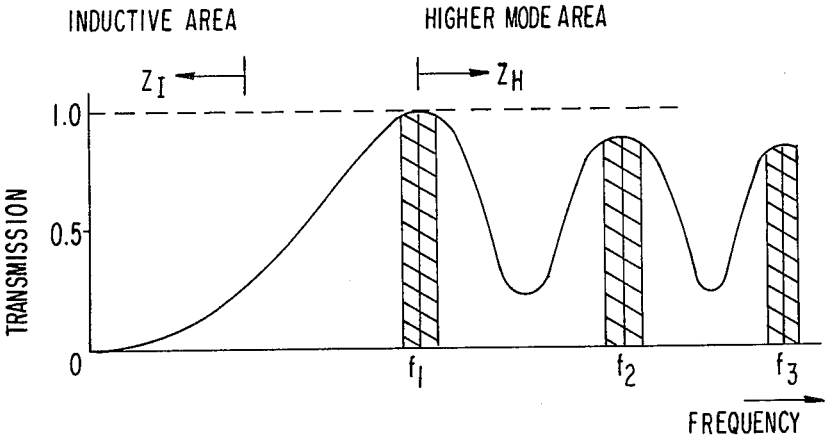
FIG. 4 shows the frequency characteristic for transmission of the lattice illustrated in FIG. 2.

A conventional FSRS illustrated in FIG. 2 consists of a metallic square-apertured lattice 15. When an incident wave $S_{IN}$ comes in on the lattice 15 as shown in FIG. 3, it is separated into a reflected wave $S_R$ and a transmitted wave $S_T$ according to the frequency of the incident wave. The proportion of the transmitted energy to the incident energy, i.e., the frequency-dependence of the transmission is such as illustrated in FIG. 4. Thus, in a relatively low frequency zone ($Z_I$), the FSRS apparently acts as an inductance, and its transmission is 1 in principle at a resonance frequency of $f_1$. In a higher frequency zone ($Z_H$), higher modes arise, each mode having a resonance frequency of $f_2$, $f_3$ or the like.

Figure 5A:
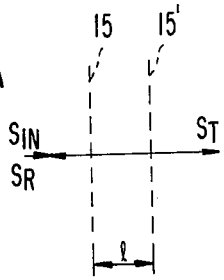
FIGS. 5A–5C respectively illustrate the structure, equivalent circuit and transmission-frequency characteristic of a frequency separator using a plurality of lattice shown in FIG. 2.
Figure 5B:
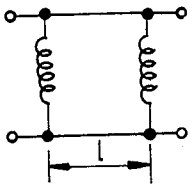
Figure 5C:
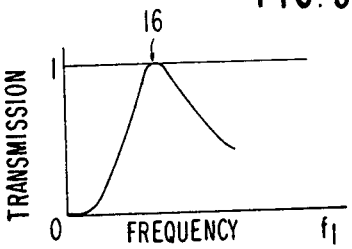

One type of conventional frequency separator uses the above-mentioned relatively low frequency zone $Z_I$. As illustrated in FIG. 5A, it has two lattices 15 and 15', each of which has the characteristic shown in FIG. 4. The lattices 15 and 15' are arranged at an interval of 1 between them, so that the separator utilizes the resonance resulting from interactions between the inductance of the two lattices. FIGS. 5B and 5C show an equivalent circuit diagram for the arrangement of FIG. 5A and the transmission characteristic thereof, respectively. As seen from FIG. 5C, this frequency separator can have a resonance point 16 attributable to interactions between its two lattices in the inductance zone $Z_I$ having a frequency lower than the inherent resonance frequency $f_1$ of the lattices. It was already pointed out that, because the resonance characteristic curve of the frequency separator is steeply inclined, the separator needs a greater number of lattices to obtain a wider band pass characteristic, and therefore is uneconomical and susceptible to greater transmission losses.

Furthermore, in a frequency separator structured as illustrated in FIG. 5A having square-shaped lattice apertures, if electromagnetic waves obliquely come in on an FSRS, as stated above, the TE incident wave and the TM incident wave will have different frequency characteristics. This disadvantage can be obviated by using rectangular lattice apertures and so adjusting their size and periodicity of arrangement that the inductances of the vertical and horizontal strips be identical with each other, as proposed in the above-cited article by Saleh et al.

On the other hand, the frequency separator designed by the present inventors to achieve a broader band pass characteristic has its pass band in the region where the FSRSs can be regarded as the resonance elements of LCs rather than inductances like in previous separators. In an RSRS designed in this way, the identity of the inductance components of the strips, that is proposed by Saleh et al as referred to above, by itself is inadequate for eliminating the disparity between the pass bands of the TE incident wave and the TM incident wave or preventing the occurrence of the dip in which a signal to be transmitted is blocked.

Figure 6A:
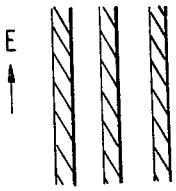
FIGS. 6A and 6B are respectively an explanatory structural diagram and an equivalent circuit diagram of a case in which the plane of polarization of the incident wave is parallel to the strips of the lattice.
Figure 6B:
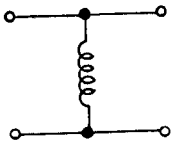
Figure 7A:
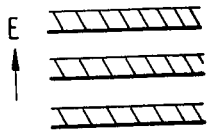
FIGS. 7A and 7B are respectively an explanatory structural diagram and an equivalent circuit diagram of a case in which the plane of polarization of the incident wave is perpendicular to the strips of the lattice.
Figure 7B:
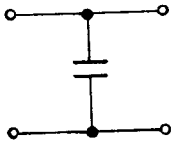

Hereinafter will be explained in the principle of a frequency separator whose pass band is set in the region where lattices can be regarded as LC resonance elements to constitute one feature of the present invention. It is first supposed that a square-apertured lattice is a combination of vertical parallel strips and horizontal parallel strips. Or it is assumed that the parallel strips of FIG. 6A and those of FIG. 7A are put together to constitute the square-apertured lattice shown in FIG. 2. When the plane of polarization E is parallel to parallel strips as in FIG. 6A, the equivalent circuit can be represented by an inductance L as in FIG. 6B. When the plane of polarization E is perpendicular to parallel strips as in FIG. 7A, the equivalent circuit can be represented by a capacitance C as in FIG. 7B. Therefore, the equivalent circuit of a square-apertured lattice can be represented by an L-C resonance circuit, though in the frequency region above its resonance frequency $f_1$ the equivalent circuit cannot be so simply represented because, as stated above, such a frequency region is of higher modes. The frequency characteristic of the lattice, represented by an L-C resonance circuit, is below the frequency $f_1$ in FIG. 4. In the lower frequency zone where the effect of said capacitance C is reduced, only the inductance L is relevant.

Figure 8A:
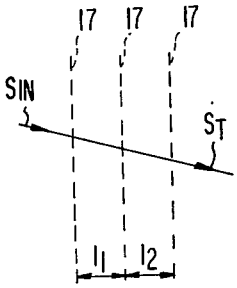
FIGS. 8A–8C respectively show a structural diagram, an equivalent circuit diagram and a transmission-frequency characteristic diagram for explaining the principle of the frequency separator according to the present invention.
Figure 8B:
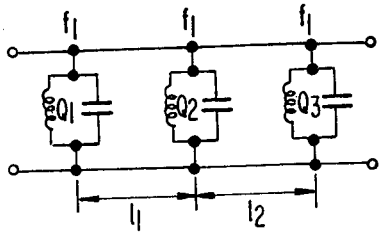
Figure 8C:
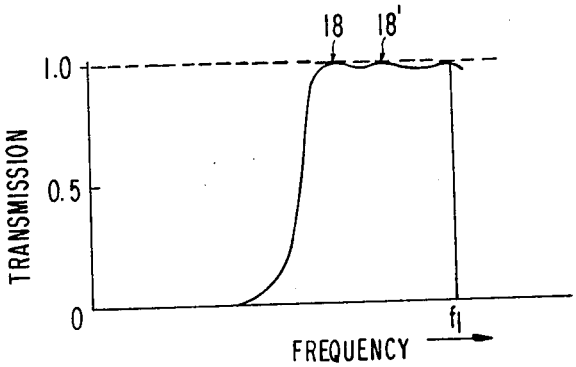

The pass band of a frequency separator can be set in the region which can be regarded as the L-C resonance zone of each of its lattices in the following manner. As illustrated in FIG. 8A, three lattices 17 are arranged in parallel to one another at intervals of $l_1$ and $l_2$. The equivalent circuit of this arrangement can be represented by FIG. 8B. If the frequencies of inherent resonances of the lattice 17 are equally designed at $f_1$, the transmission of the separator arranged as FIG. 8A will be 1 at frequency $f_1$. Further, to avert a region of higher modes, $f_1$ is set slightly above the upper limit of the pass band to be used. The Q factors of the L-C resonance circuits being represented by $Q_1$, $Q_2$ and $Q_3$, two resonance points attributable to interactions between the lattices (two for three lattices 17) can be created, as represented by 18 and 18' in FIG. 8C, in addition to the inherent resonance point $f_1$ if Q factors $Q_1$, $Q_2$ and $Q_3$ and the intervals $l_1$ and $l_2$ between the lattices are properly selected. In this case, the Q factor of each lattice and the intervals between the lattices should be so selected that the two additional resonance points may not enter the region of higher modes but can be realized in lower frequencies than $f_1$ and yet can cover the pass band. In this manner the characteristic illustrated in FIG. 8C is achieved.

The Q factor of each lattice, as shown in FIG. 2, is determined by the a/dx ratio of the apertures and strips, while the resonance point $f_1$ is determined by the ratio $dx/\lambda$ of the period of the lattice to the wavelength $\lambda$. Therefore, by properly selecting a and dx, the lattice can be given any desired $f_1$ and Q.

If the pass band of a frequency separator is set in the L-C resonance region of its lattices, the pass band can be further broadened, compared with that of a frequency separater using L resonance region. In this case too, however, if the apertures of the lattice are square, oblique incidence of electromagnetic waves on the FSRSs would invite deterioration of the frequency separating performance.

Next will be described an embodiment of the present invention in which this deterioration problem is solved.

Figure 9:
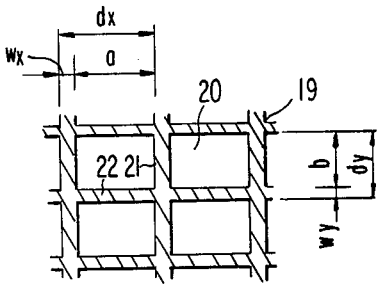
FIG. 9 illustrates the structure of a frequency-selective reflecting surface (FSRS) according to the present invention.

In an FSRS shown in FIG. 9, a lattice 19 of rectangular periodic pattern has apertures 20 having a width a in the direction of the x axis and a width b in the direction of the y axis. Also, the lattice 19 is composed by conductive strip members 21 having a width $W_x$ in the direction of the x axis and conductive strip members 22 having a width $W_y$ in the direction of the y axis. The periods of the lattice 19 in the directions of the x axis and the y axis are dx $(=a+W_x)$ and dy $(=b+W_y)$, respectively.

Figure 10A:
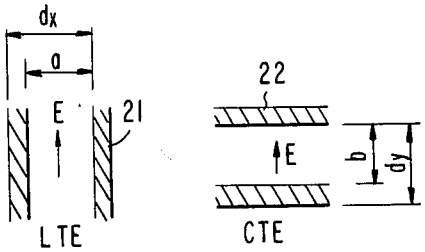
FIGS. 10A–10B are diagrams for explaining the operation principle of the lattice shown in FIG. 9.
Figure 10B:
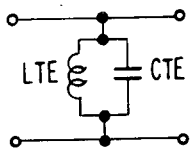
Figure 10C:
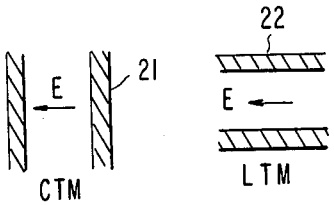
Figure 10D:
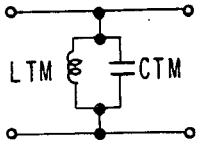

As illustrated in FIGS. 10A and 10B, the vertical strips 21 function as inductances L in the case of TE incident wave or as capacitances C in TM incident wave, while the horizontal strips 22 act as capacitances C in TE incident wave or as inductances L in TM incident wave. As shown in FIG. 10B, an inductance $L_{TE}$ in the case of TE incident wave and a capacitance $C_{TM}$ in TM incident wave are mainly determined by the period dx and the aperture size a in the horizontal direction. More definitely, they are given by $L_{TE}=L_{TE}(dx, a)$ and $C_{TM}=C_{TM}(dx, a)$, respectively. Further, an inductance $L_{TM}$ in TM incident wave and a capacitance $C_{TE}$ in TE incident wave are primarily determined by the period dy and the aperture size b in the vertical direction. In other words, they are given by $L_{TM}=L_{TM}(dy, b)$ and $C_{TE}=C_{TE}(dy, b)$, respectively. Accordingly, in order to obtain a Q factor and a resonance frequency $f_1$ both common to the TE incident wave and the TM incident wave, the two Ls and the two Cs have to be equal to each other to satisfy the following equations:

$$L_{TE}(dx, a) = L_{TM}(dy, b) = L$$

$$C_{TE}(dy, b) = C_{TM}(dx, a) = C$$

$$Q = \tfrac{1}{2}\sqrt{\frac{C}{L}}$$

$$f_1 = \frac{1}{2\pi\sqrt{LC}}$$

It was observed in an experiment that, as the angle of incidence $\theta$ widened, the resonance frequency of the TE wave shifted toward a lower frequency region. This TE wave resonance frequency is also dependent on the period dx in the horizontal direction, so that it can be returned to its original frequency by reducing dx. The TM wave resonance frequency is dependent on the aperture size dy, so that it can be brought closer to the TE wave resonance frequency by reducing dy. Since reducing dx and dy by oblique incidence results in smaller equivalent inductances and a greater Q, these consequences can be compensated for by reducing the strip widths wx and wy to increase the inductances.

Figure 12:
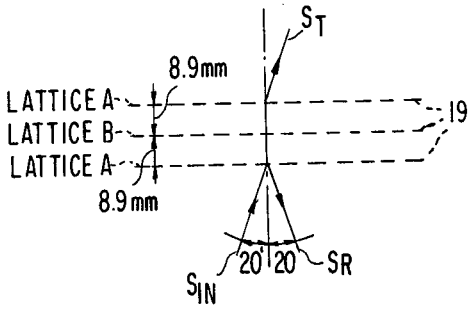
FIG. 12 shows an arrangement of a frequency separator composed by arraying three lattices of the kind illustrated in FIG. 9.
Figure 11A:
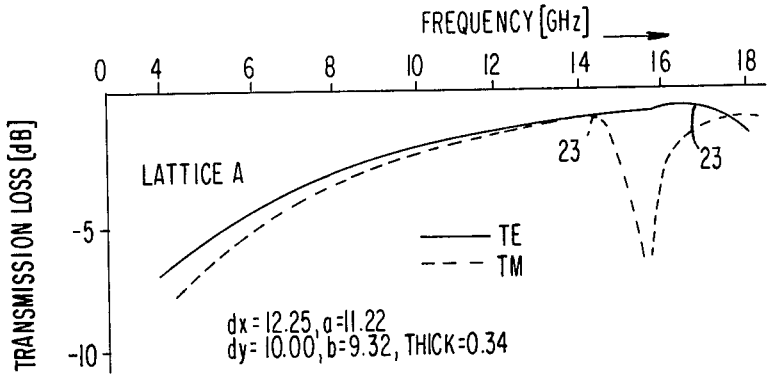
FIGS. 11A and 11B illustrate the frequency characteristics for transmission-loss of the lattice shown in FIG. 9.
Figure 11B:
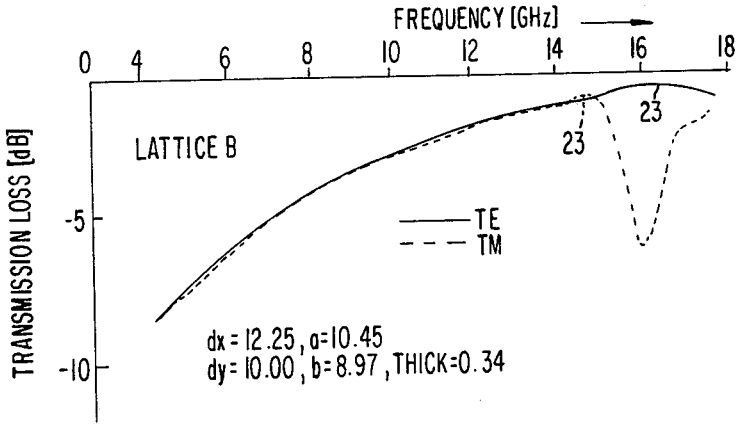
Figure 11C:
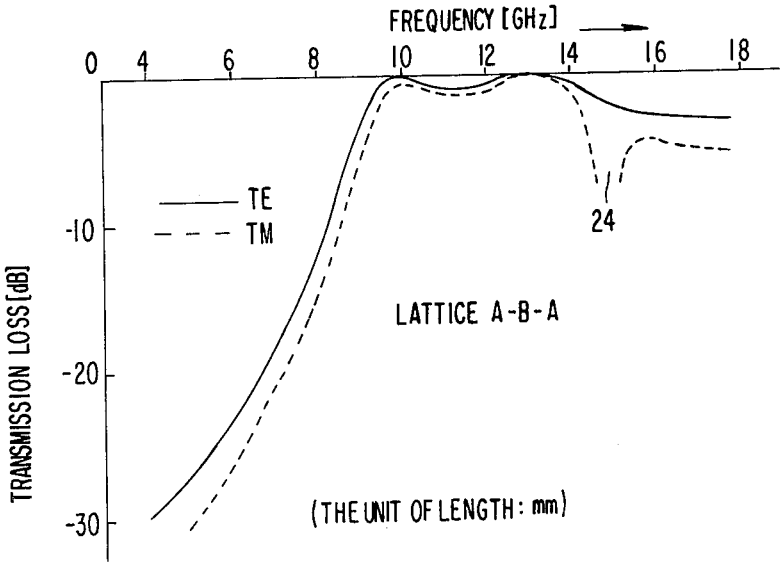
FIG. 11C illustrates the frequency characteristic for transmission of a combination of lattices of FIG. 9 which are arranged as shown in FIG. 12.

In FIG. 11 are shown experimental data on the transmission loss-frequency characteristic of the FSRS according to the present invention, illustrated in FIG. 9. By putting together a rectangular lattice A manifesting the characteristic shown in FIG. 11A and another rectangular lattice B manifesting the characteristic shown in FIG. 11B into a three-layer combination A-B-A as illustrated in FIG. 12, there is provided a frequency separator having a broad pass band as shown in FIG. 11C. Reference numerals 23 in FIGS. 11A and 11B represent resonance points. The angle of incidence $\theta$ of signals coming into the separator is 20°, and the intervals between adjoining lattices are 8.9 mm each. The rectangular lattices 19 were designed with reference to theoretical analyses by the Moment method, and the specific dimensions (dx, dy, a and b) of their apertures and plate thickness are stated in FIG. 11 in millimeters.

As is obvious from the frequency characteristics in FIG. 11C, the arrangement of lattices, structured as shown in FIG. 9, in the manner illustrated in FIG. 12 eliminates the difference in characteristics with the plane of polarization in the case of oblique incidence, or approximately equalizes the resonance characteristics of the TE incident wave and the TM incident wave. As a result, the pass band of the separator can be instituted about 4 GHz in its width, as seen from FIG. 11C. However, there still is a dip, represented by a reference numeral 24 in FIG. 11C, correspondingly limiting the pass band width.

Figure 13A:
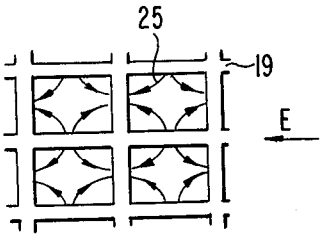
FIGS. 13A and 13B are diagrams for describing the present invention.
Figure 13B:
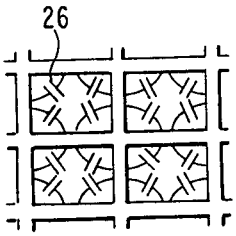

The occurrence of such a dip can be explained in the following way. The rectangular lattice arrangement shown in FIG. 9 can be regarded as an L-C parallel resonance circuit in which an inductive strip grating and a capacitive strip grating are combined. The oblique incidence of a TE wave on this lattice arrangement can be substantially explained by the function of the L-C resonance circuit. However, if a TM wave comes in, a $TE_{11}$ mode 25 will be induced on the apertures as illustrated in FIG. 13A and therefore, the equivalent circuit cannot be represented by a simple L-C parallel resonance circuit around the dip. Thus, because of the presence of the $TE_{11}$ mode, there will newly arise capacitances 26 between vertical and horizontal strips as shown in FIG. 13B. By the actions of these capacitances and the inductances of the lattice, there arises the dip point 24 (FIG. 11C) in the case of TM incidence. In the rectangular lattice 19 of FIG. 9 in such a case, since the $TE_{11}$ mode occurring in the upper aperture and that arising in the lower aperture are the same in pattern of distribution and in phase as illustrated in FIG. 13A, these effects reinforce each other by interactions and thereby substantially affect the characteristic of the separator.

Figure 14:
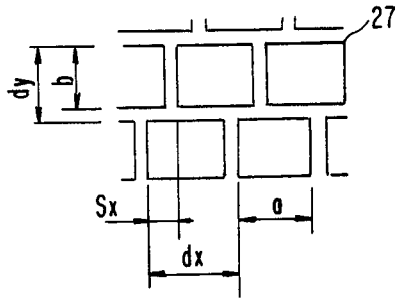
FIG. 14 illustrates the structure of another embodiment of an FSRS according to the present invention.

Therefore, with a view to obviating these interactions, the present invention displaces the apertures of the rectangular lattice in relative arrangement between their adjoining rows. FIG. 14 shows a plan view of an FSRS composed in such a manner.

Figure 15:
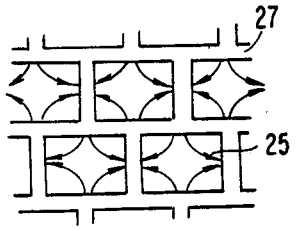
FIG. 15 is a diagram for explaining the operation of the lattice shown in FIG. 14.

In FIG. 14, the pattern of the rectangular lattice is a brickwork arrangement wherein a periodic pattern 27, consisting of a conductor, is displaced to a prescribed extent in the direction of the x axis. This arrangement makes it possible to control the position of the dip point attributable to a TM incident wave. Thus in the rectangular lattice arrangement illustrated in FIG. 14, since the $TE_{11}$ mode occurring in the upper row of the pattern and that arising in the lower row of the pattern are not aligned with each other either in distribution pattern or in phase as shown in FIG. 15, the effects of the capacitances 26 work in the mutually weakening direction. Accordingly, the dip point 24 (FIG. 11C) attributable to the TM incident wave can be shifted toward a higher frequency and outside the band.

Figure 16:
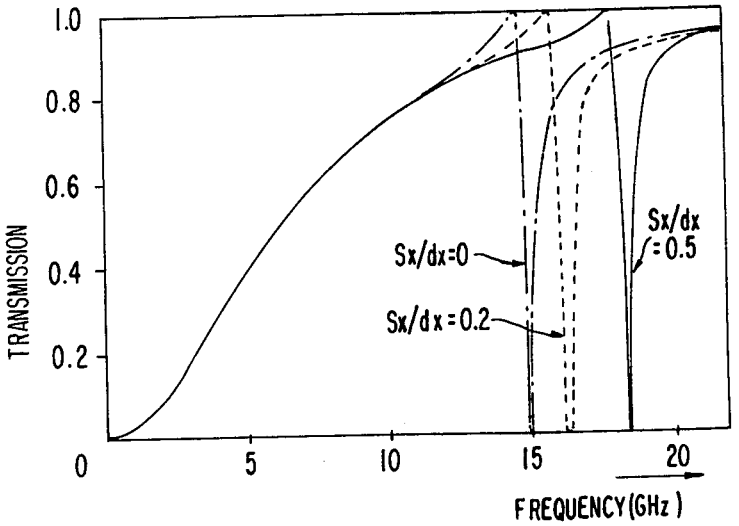
FIG. 16 shows the theoretical transmission-frequency characteristic by the Moment method with respect to the lattice shown in FIG. 14.
Figure 17A:
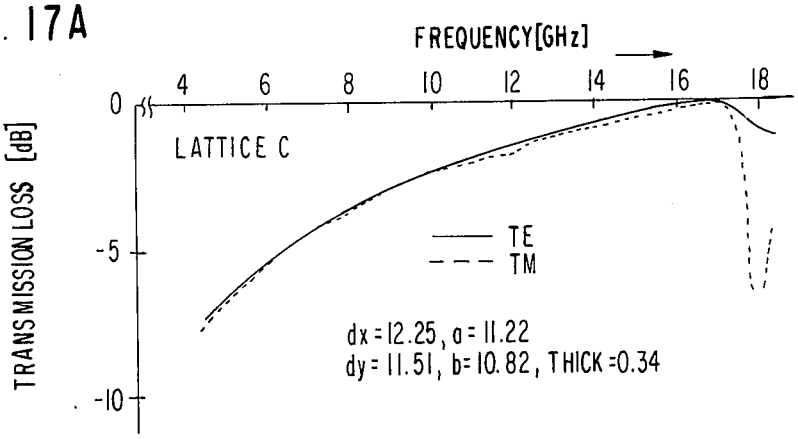
FIGS. 17A–17C illustrate the actually measured transmission loss-frequency characteristics of a single lattice of the type shown in FIG. 14 and of three such lattices combined as shown in FIG. 12.
Figure 17B:
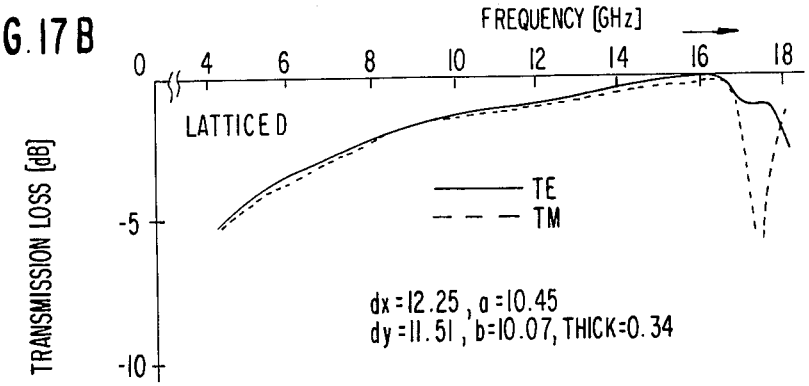
Figure 17C:
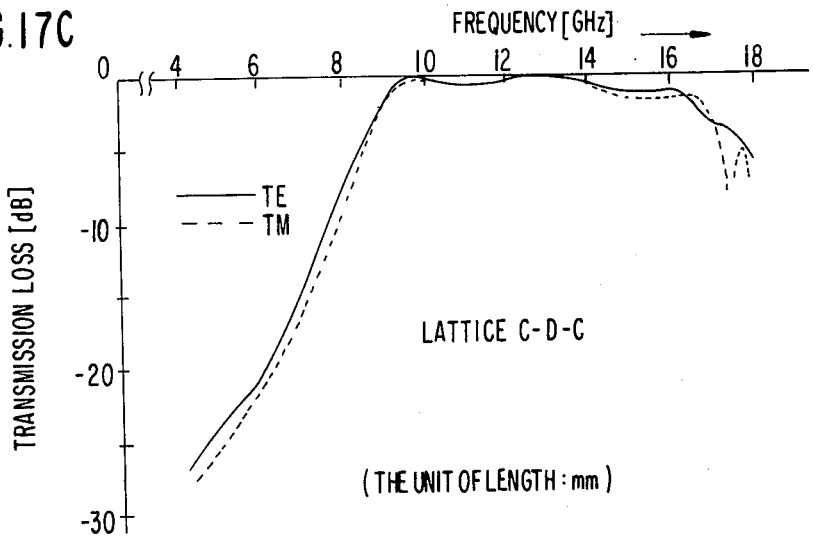

The results of calculations by the Moment method with respect to individual lattices are shown in FIG. 16, with the ratio of horizontal displacement of the lattice (Sx/dx) being set at 0, 0.2, and 0.5. The dimensions of the lattice are, as expressed with reference to FIG. 14: dx=12.25 mm, dy=11.51 mm, a=11.22 mm and b=10.82 mm. Whereas the dip point shifts according to the ratio of displacement (Sx/dx) as shown in FIG. 16, it may be understood that the shifting effect is the greatest at a displacement ratio of 50 percent. The experimentally measured values of the individual transmission loss-frequency characteristics of FSRSs C and D, whose lattices are displaced by 50 percent as stated above, are illustrated in FIGS. 17A and 17B, respectively, and those of the transmission loss-frequency characteristics of the three-layer combination C-D-C of these FSRSs C and D in the same manner as shown in FIG. 12 are given in FIG. 17C. These measured values are well in agreement with the calculated values shown in FIG. 16. The pass band is broadened by about 2 GHz than that shown in FIG. 11C by the shift of the dip point.

Figure 18:
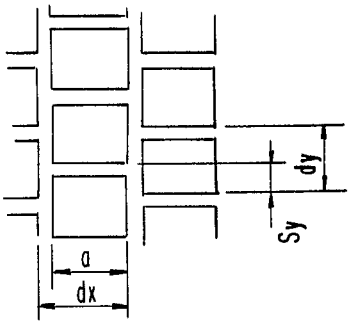
FIG. 18 illustrates another embodiment of the present invention.
Figure 19:
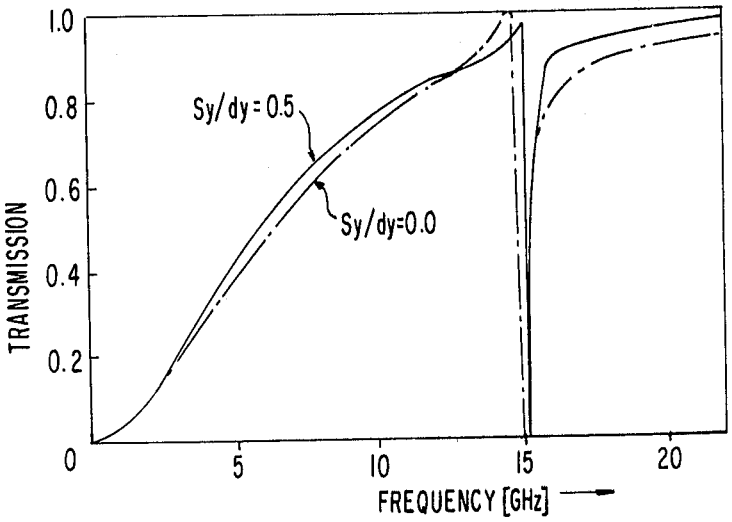
FIG. 19 shows an example of theoretical transmission-frequency characteristics of the lattice shown in FIG. 18.

The principle of the present invention applies not only to rectangular aperture lattice but also to circular, elliptical, crossed aperture lattice or aperture lattices of any shapes including combinations thereof. These lattice pattern may be formed on a dielectric substrate. Although FIG. 14 illustrates horizontal displacement of the lattice, it can as well be displaced vertically. An example of such vertical displacement is shown in FIG. 18, and the calculation results of its transmission frequency characteristic by the Moment method are given in FIG. 19. The dip point shifting effect of this vertical displacement, though smaller than that of the horizontal displacement, is evident, seeming to promise a broader band for a separator in which FSRSs are arranged as illustrated in FIG. 12, like in the case of FIG. 17C. The dimensions of the lattice shown in FIG. 18 are: dx=12.25 mm, dy=11.51 mm, a=11.22 mm and b=10.82 mm.

Figure 21A:
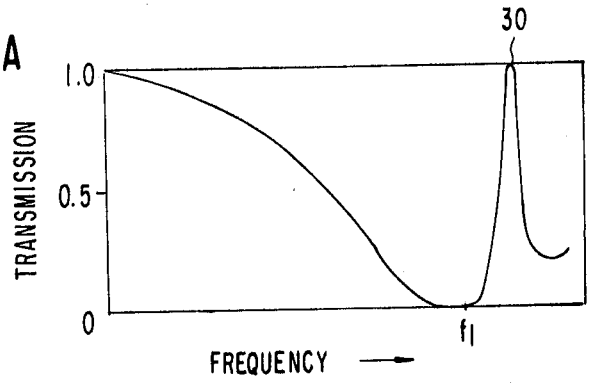
FIGS. 21A and 21B are diagrams for explaining the lattice shown in FIG. 20.
Figure 20:
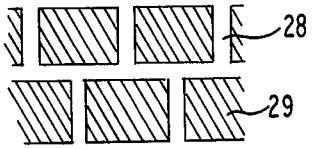
FIG. 20 shows still another embodiment of the present invention.
Figure 21B:
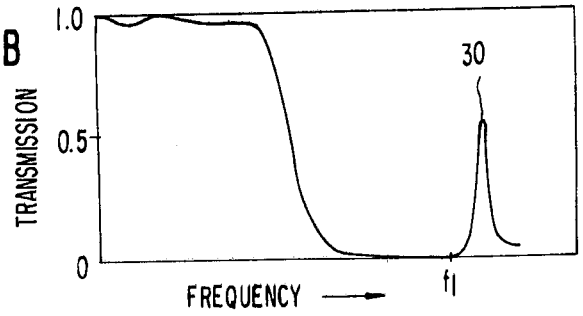

FIG. 20 illustrates the structure of a low-pass type FSRS in which the aperture parts (28) and the metallic parts (29) are reversed, and this type FSRS and a high-pass type FSRS would complement each other. The metallic parts 29 are preferably formed on a dielectric substrate. The individual transmission-frequency response of this lattice is shown in FIG. 21A, and the characteristic of a three-layer combination of such lattices, like in FIG. 12, is shown in FIG. 21B. A peak point 30 in the figures limits the width of the reflective band, but it can be shifted to broaden the band by displacing the lattice pattern, as in the case of the high-pass type lattice described above.

Our experiment has shown that, a mutual displacement between the apertures of lattices in the three-layer combination separator as shown in FIG. 12 causes as substantial differences in frequency characteristics from that of another three-layer combination separator with their apertures identical to each other.

Figure 22A:
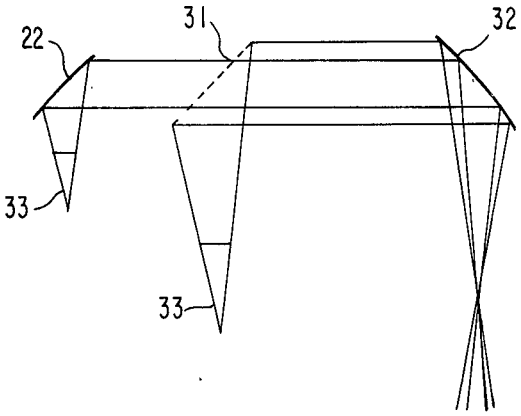
FIGS. 22A–22F illustrate how FSRSs according to the present invention can be used.

FIGS. 22A–22F illustrate some conceivable applications of the frequency separator according to the present invention. FIG. 22A shows a separator 31 according to the invention, formed in a curved shape and used as a beam waveguide curved mirror. Reference numeral 32 represents curved reflective mirrors and 33, electromagnetic feed horns.

Figure 22E:
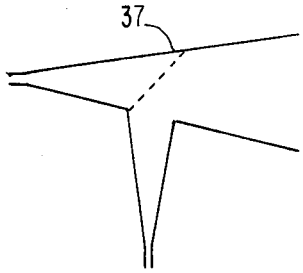
Figure 22B:
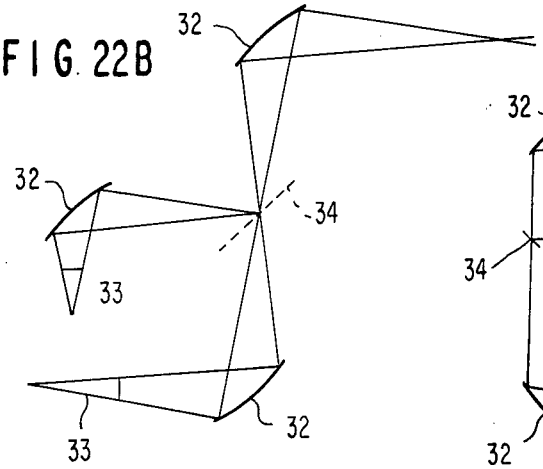
Figure 22C:
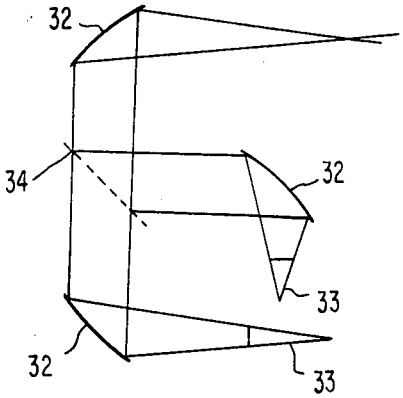
Figure 22D:
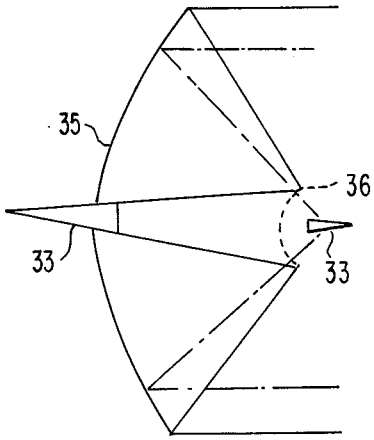
Figure 22F:
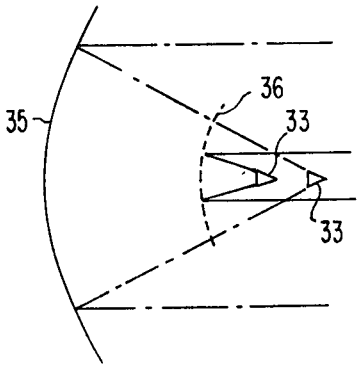

FIGS. 22B and 22C show a flat frequency-separating FSRS 34 according to the invention used as beam waveguides. In each of FIGS. 22D and 22F there is depicted a frequency-sharing antenna by implementing the invention in the form of a sub-reflective mirror 36 for a Cassegrain and parabolic antennas, respectively. Reference numeral 35 represents a main reflective mirror.

FIG. 22E illustrates an instance in which a frequency-sharing horn is composed by inserting a frequency-separating FSRS 37 according to the present invention into an electromagnetic feed horn.

What is claimed is:

1. A frequency separator means for use in an antenna apparatus, said means comprising, a plurality of frequency-selective reflecting surface members for separating electromagnetic waves, each of said surface members composed of a lattice of conductive material having a periodic pattern, said lattice exhibiting the effect of an inductive-capacitive circuit element in a first relatively low frequency region and having an inherent resonance frequency at a frequency higher than said first region, said lattice being shaped to exhibit substantially equal inductance and capacitance with respect to obliquely incident TE and TM mode electromagnetic waves at said inherent resonance frequency and said first region, all of said surface members having substantially equal inherent resonance frequencies, and said surface members being disposed to have interactive resonance at frequencies within said first region.

2. A frequency separator means as claimed in claim 1, wherein said frequency separator means is transmissive at both said inherent resonance frequency and said interactive resonance frequency.

3. A frequency separator means as claimed in claim 2, wherein said periodic pattern of conductive material defines apertures having any one of rectangular, elliptical, crossed and circular shapes.

4. A frequency separator means as claimed in claim 2, wherein said periodic pattern defines rows of apertures, the aperatures in each row being displaced from those in adjacent rows.

5. A frequency separator means as claimed in claim 4, wherein said adjacent rows of apertures are displaced half the period of said periodic pattern.

6. A frequency separator means as claimed in claim 1, wherein said frequency separator means is reflective at said inherent resonance frequency and transmissive at said interactive resonance frequency.

7. An antenna apparatus comprising a frequency separator means as claimed in claim 1, a reflector means disposed on one side of said surface members for reflecting one of said electromagnetic waves, and two horn means disposed on the other side of said surface members to feed said electromagnetic waves to said surface members.

8. An antenna apparatus as claimed in claim 7, wherein said periodic pattern of conductive material is defined by rectangular apertures.

9. An antenna apparatus as claimed in claim 8, wherein said apertures are mutually displaced in one dimension by half the period of said periodic pattern.

10. An antenna apparatus as claimed in claim 7, wherein said periodic pattern of conductive material is of rectangular shape.

11. An antenna apparatus as claimed in claim 10, wherein said periodic pattern of conductive material is mutually displaced by half the period of said periodic pattern.

12. An antenna apparatus comprising a frequency separator means as claimed in claim 1, said antenna apparatus further comprising reflector means disposed on one side of said surface members for reflecting said electromagnetic waves, and two horn means disposed on opposite sides, respectively, of said surface members, to feed said electromagnetic waves to said surface members.

13. An antenna apparatus as claimed in claim 12, wherein said periodic pattern of conductive material is defined by rectangular apertures.

14. An antenna apparatus as claimed in claim 13, wherein said apertures are mutually displaced by half the period of said periodic pattern.

15. A frequency separator as claimed in claim 12, wherein said periodic pattern of conductive material is of rectangular shape.

16. A frequency separator as claimed in claim 15, wherein said periodic pattern of conductive material is mutually displaced by half the period of said periodic pattern.

17. A frequency separator means as claimed in claim 6 wherein each said lattice comprises a plurality of rows and columns of shaped conductive material positioned periodically in said rows and columns.

18. A frequency separator means as claimed in claim 17 wherein said shaped conductive material has any one of rectangular, elliptical, crossed or circular shape.

19. A frequency separator means as claimed in claim 17 wherein the shaped conductive materials in each row are displaced from the shaped conductive materials in adjacent rows.

20. A frequency separator means as claimed in claim 19 wherein the adjacent rows of shaped conductive materials are displaced from one another by half the period of said periodic pattern.

* * * * *

UNITED STATES PATENT AND TRADEMARK OFFICE

CERTIFICATE OF CORRECTION

PATENT NO. : 4,476,471

DATED : October 9, 1984

INVENTOR(S) : Ikuro SATO et al.

It is certified that error appears in the above-identified patent and that said Letters Patent is hereby corrected as shown below:

Column 3, line 15, change "10A-10B" to --10A-10D--;

line 51, after "antenna" insert --apparatus--.

Column 4, line 50, change "RSRS" to --FSRS--;

line 57, delete "in".

Signed and Sealed this

*Fourteenth* Day of *May 1985*

[SEAL]

*Attest:*

DONALD J. QUIGG

*Attesting Officer* *Acting Commissioner of Patents and Trademarks*